US005171065A

United States Patent [19]

Steinkuhl et al.

[11] Patent Number: 5,171,065

[45] Date of Patent: Dec. 15, 1992

[54] MINERAL MINING INSTALLATION WITH CHAIN-TENSIONING SYSTEM

[75] Inventors: Bernd Steinkuhl, Lunen; Norbert Hesse, Bochum, both of Fed. Rep. of Germany

[73] Assignee: Gewerkschaft Eisenhutte Westfalia GmbH, Fed. Rep. of Germany

[21] Appl. No.: 733,321

[22] Filed: Jul. 22, 1991

[30] Foreign Application Priority Data

Jul. 27, 1990 [DE] Fed. Rep. of Germany ..... 4023815

[51] Int. Cl.[5] ..... E21C 29/16

[52] U.S. Cl. ..... 299/34; 198/517; 198/520; 299/43; 474/113

[58] Field of Search ..... 299/1.6, 34, 43; 474/101, 113, 114; 198/517, 520

[56] References Cited

U.S. PATENT DOCUMENTS

| | | | |
|---|---|---|---|
| 3,790,210 | 2/1974 | Georg | 299/43 |
| 3,809,431 | 5/1974 | Nakajima | 299/34 |
| 4,037,876 | 7/1977 | Georg et al. | 299/43 |
| 4,548,444 | 10/1985 | Brever et al. | 299/34 |
| 4,826,469 | 5/1989 | Cooley | 474/113 X |

FOREIGN PATENT DOCUMENTS

| | | |
|---|---|---|
| 2554785 | 6/1977 | Fed. Rep. of Germany . |
| 1224294 | 11/1969 | United Kingdom . |

*Primary Examiner*—David J. Bagnell

*Attorney, Agent, or Firm*—Samuels, Gauthier & Stevens

[57] ABSTRACT

A plough box containing a chain wheel driving a chain to propel a chain used to move a plough is mounted for displacement alongside a machine frame at one end of a scraper-chain conveyor. To adjust the tension in the chain a motor is operated to drive a self-locking worm gearing which employs a worm wheel meshing with a rack fixed to the machine frame and extending in the direction of the chain.

13 Claims, 3 Drawing Sheets

MINERAL MINING INSTALLATION WITH CHAIN-TENSIONING SYSTEM

FIELD OF THE INVENTION

The present invention relates to mineral mining installations and more particularly to chain tensioning systems for use in such installations.

BACKGROUND TO THE INVENTION

It is well known to win mineral, e.g. coal, with the aid of a machine such as a plough which is hauled back and forth along a scraper-chain conveyor. The plough is propelled with the aid of a chain driven with drive means at a drive station at one end of the conveyor. In such an installation it necessary to adjust the tension in the drive chain from time to time. Normally the drive chain is entrained around a chain wheel in a housing, the so-called "plough box" which is moved along with associated drive motor and gearing in relation to a machine frame of the drive station to adjust the tension.

In DE-OS 2554785 a hydraulic piston and cylinder unit is used to move the plough box. The cylinder of the unit is mounted to a side plate of the frame and the plough box is fixed in a variety of pre-set positions by a locking member such as a bolt, engaging in a row of holes after the unit has adjusted the chain tension.

There is a need for an improved chain tensioning system.

SUMMARY OF THE INVENTION

According to the invention a chain tensioning system is composed of a least one motor driving a self-locking worm gearing. Conveniently the motor is mounted to the plough or housing box and its associated drive and rotates a worm wheel which meshes with a rack fixed to the machine frame and extending in the direction of the chain to be tensioned. In contrast to the known designs it is not necessary to fix the plough box in its desired position after tensioning and the range of tensions which can be controlled is continuous rather than incremental. The motor need only operate when adjustment of tension is required and the plough box will remain in its adjusted position after the motor has been halted. Furthermore the relatively large hydraulic unit used in the previously-mentioned design is replaced by one or more small motors preferably hydraulic motors. In a preferred embodiment two hydraulic motors in the form of reversible radial piston motors drive a common shaft carrying a worm.

The worm gearing is conveniently a reduction gearing of compact size mounted in the plough box or in a subhousing.

The rack is best fixed to a strong bearing plate fitted to the side plate of the machine frame and this bearing plate and the plough box or housing are then provided with guide means such as rails or bars engaged with hooks, claws or flanges.

In a preferred design, a small worm wheel can mesh with the worm driven by the motor or motor and a shaft carrying the small worm wheel also carries a larger worm wheel which actually meshes with the rack. The worm wheel shaft is preferably disposed in the direction of the chain to be tensioned while the worm shaft can extend vertically in the housing of the worm gearing.

It is advisable to have the plough box partly cover the rack and to have the plough box supported by its rear surface on a supplementary sliding surface of the bearing plate. The rack itself is then best recessed or countersunk in the bearing plate with respect to these sliding surfaces.

The teeth and gaps of the rack may have the shape of circular segment.

Preferably the worm gearing is enclosed to prevent the ingress of dirt and its housing can be fixed with screws to the end of the plough box or formed as a sub-housing of the plough box.

The drive motor or motors can be controlled to operate in dependence on the prevailing tension in the chain so that chain tensioning is effected automatically.

The invention may be understood more readily, and various other aspects and features of the invention may become apparent, from consideration of the following description.

BRIEF DESCRIPTION OF DRAWINGS

An embodiment of the invention will now be described, by way of example only, with reference to the accompanying drawings, wherein.

DESCRIPTION OF PREFERRED EMBODIMENT

Figure 1:
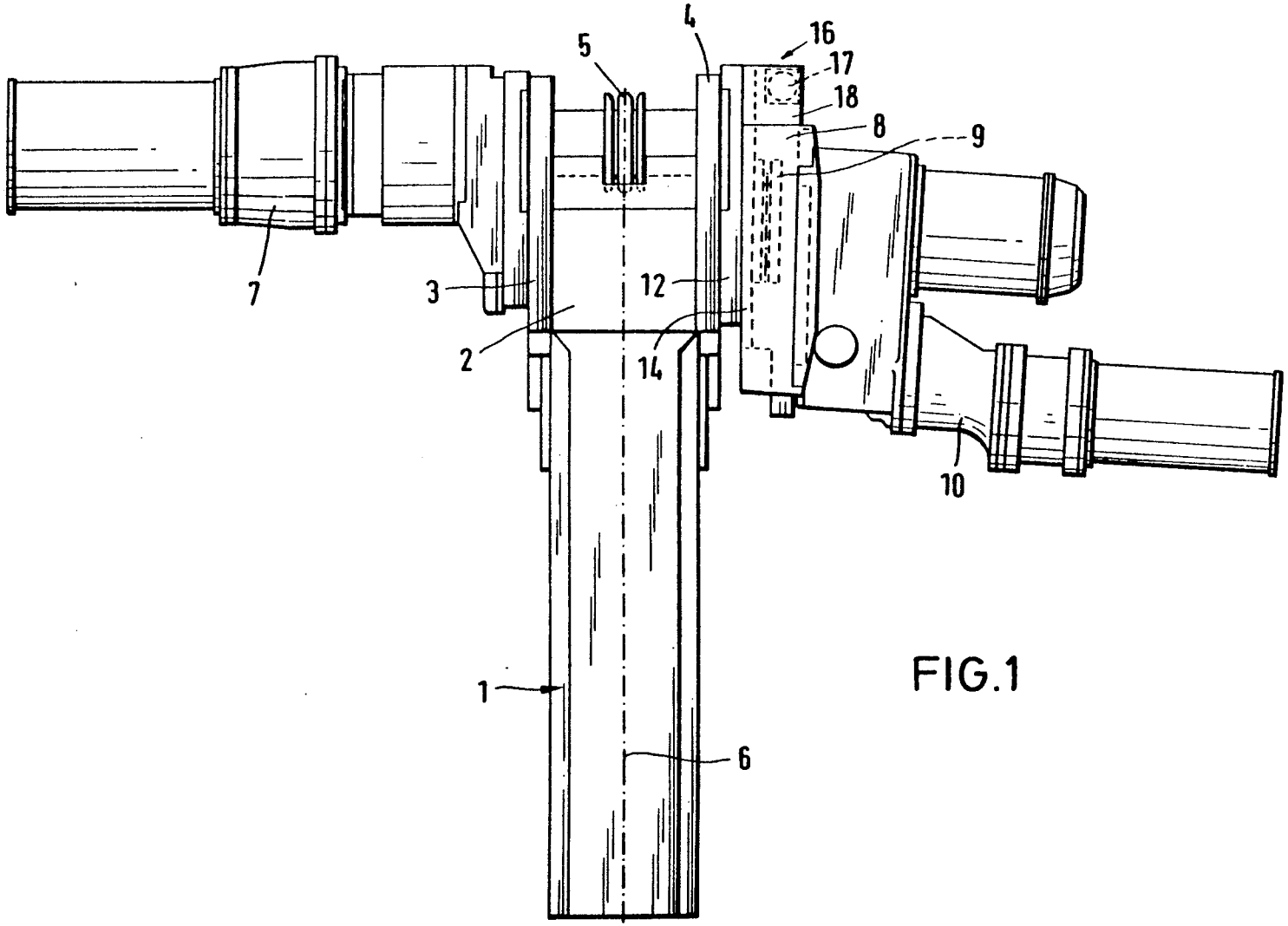
FIG. 1 is a plan view of one end of a mineral mining installation constructed in accordance with the invention.

As shown in FIG. 1, a scraper-chain conveyor 1 composed as is known, of a series of channel sections or pans disposed end-to-end has at one end a drive station with a frame 2. The frame 2 has spaced-apart side plates 3, 4 between which there is a drum 5 with a sprocket wheel around which the scraper-chain assembly of the conveyor is entrained. The scraper-chain assembly as such is not illustrated but it is generally represented by the chain-dotted line 6 in FIG. 1. The drum 5 is driven by a drive assembly 7 mounted on the side plate 3. On the opposite side plate 4 there is a housing 8 which forms the so-called plough box in which there is a rotatable toothed drive wheel 9 for driving a chain used for propelling a plough along the conveyor 1. The drive wheel 9 is driven with a drive assembly 10 mounted on the exterior of the housing 8. The housing 8 with the drive assembly 10, which can be composed of a motor and gearing, is movable in relation to the side plate 4 in order to alter the tension in the chain (not shown) entrained around the drive wheel 9.

Figure 2:
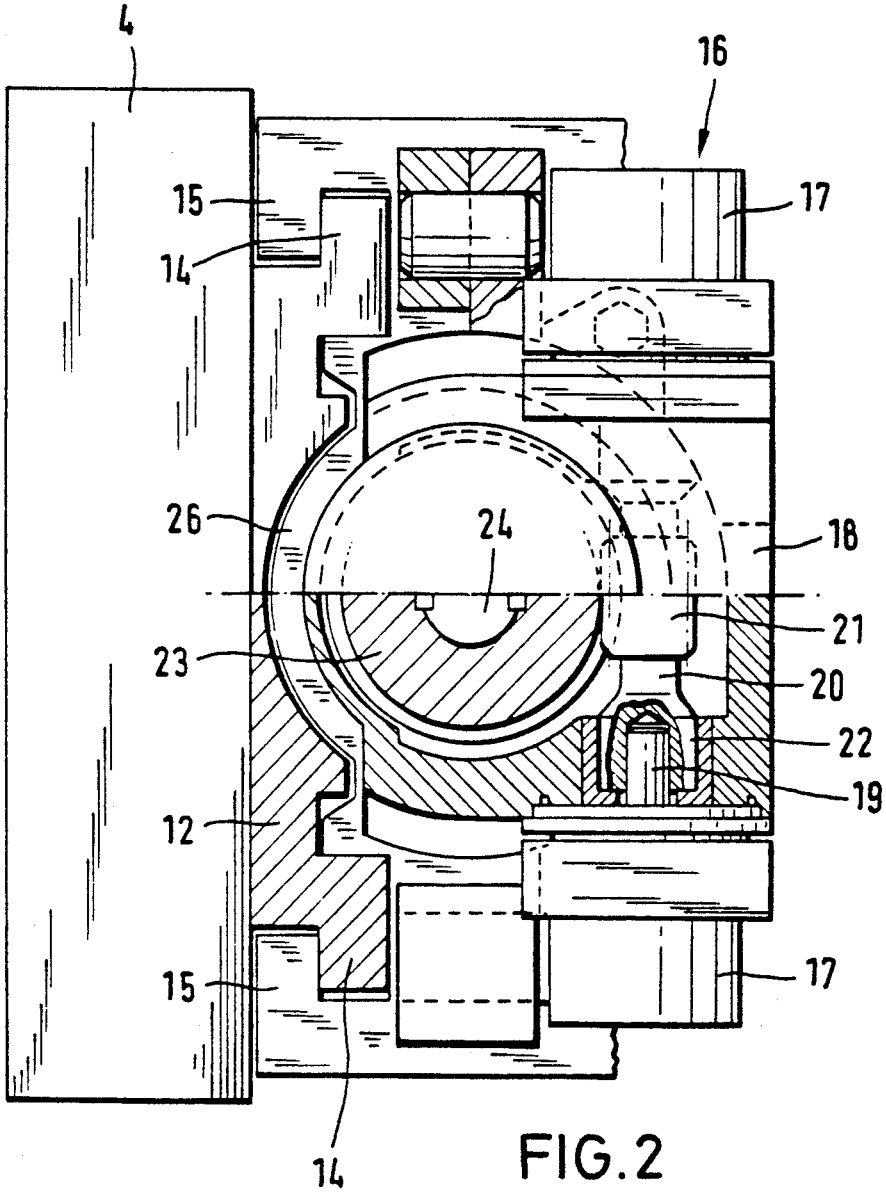
FIG. 2 is a part sectional end view of part of the installation shown in FIG. 1.
Figure 3:
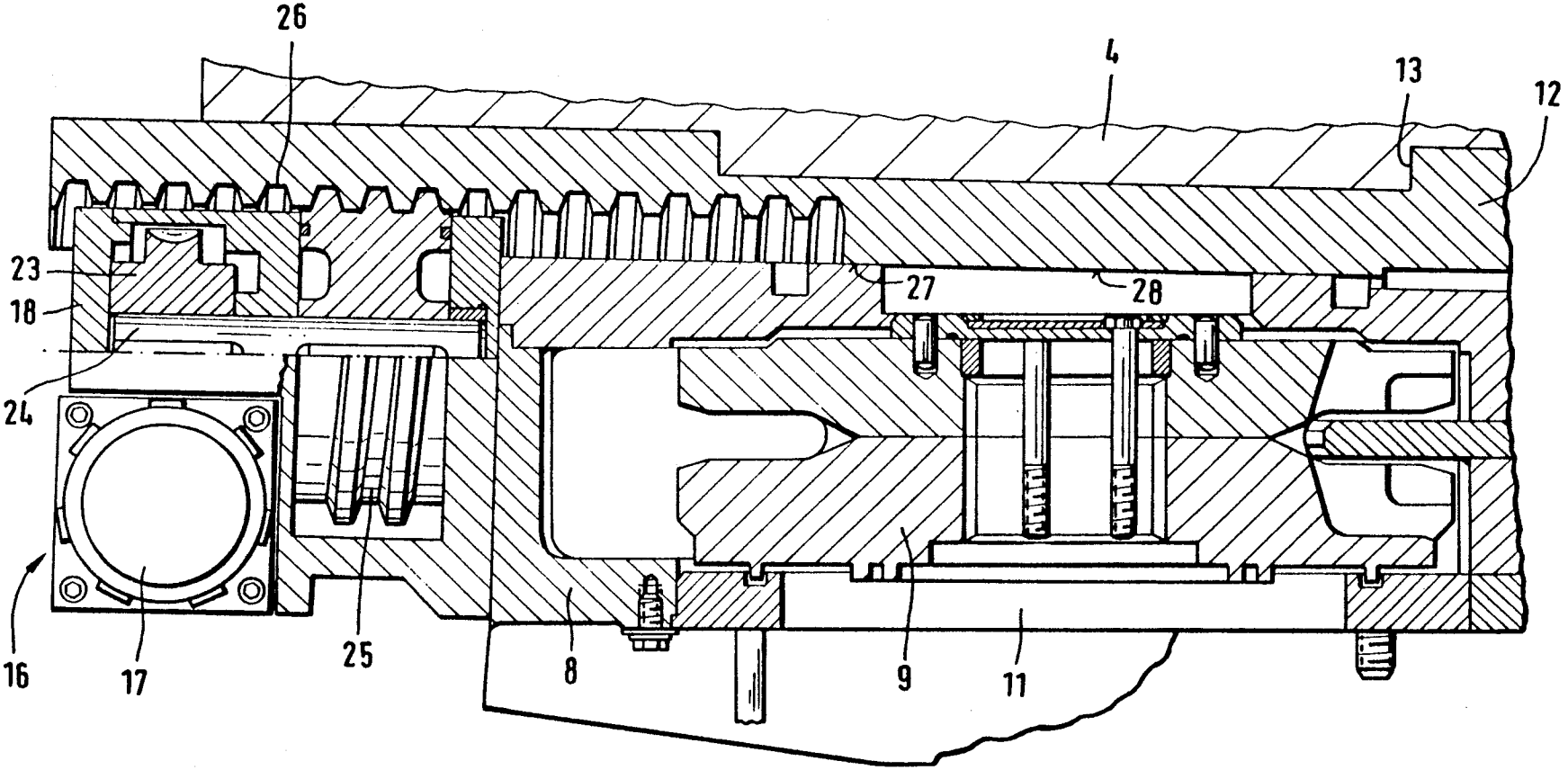
FIG. 3 is a sectional plan view of part of the installation shown in FIG. 1, the view being taken on a somewhat larger scale to FIG. 1.

FIG. 3 shows the housing 8 without the drive assembly 10. The housing 8 has an opening 11 for facilitating the installation and removal of the wheel 9 and through which an output drive shaft of the drive assembly 10 passes. As shown in FIGS. 2 and 3, a stout bearing plate 12 is mounted to the side plate 4 of the frame 2 and preferably the plate 12 is secured to the side plate 4 with screws and shape locked joints, such as mortise and tenon joints 13. The bearing plate 12 has guide bars 14 extending in the direction of the chain tensioning movement at its upper and lower regions and the housing 8 has complementary hooks or claws 15 or the like which slidably engage over the bars 14. The housing 8 is accordingly guided with this guide means 14, 15 by way of the bearing plate 12 and hence in relation to the side plate 4 of the frame 2 for movement in a chain tensioning direction and opposite.

At the end of the housing 8 remote from the conveyor 1 and the plough chain lead-in there is a device or mechanism 16 which serves to effect the movement of the housing 8 to vary the chain tension. The mechanism 16 as shown in FIG. 1 can be connected to an end face of the housing 8 with screws or the like. Alternatively the housing 8 may be extended to form a sub-housing for the mechanism 16.

In accordance with the invention, the mechanism 16 is a self-locking worm gearing and associated drive. As illustrated, the drive may take the form of two hydraulic rotary motors 17, for example radial piston motors which are disposed one above the other in a housing 18 containing at least part of the worm gear.

The motors 17 have drive shafts 19 coupled with sleeves 22 to a common shaft 20 carrying a worm 21. The worm 21 meshes with a worm wheel 23 carried on a shaft 24 rotatably mounted in the housing 18 and extending in the direction of chain tensioning. The shaft 24 also carries a second worm wheel 25 of somewhat larger diameter which meshes with a rack 26 fitted to the plate 12, and extending in the direction of chain tensioning. The rack 26 can be formed with alternate teeth and gaps shaped as circular segments. The worm wheel 25 preferably has a trapezoidal thread and the teeth of the rack 26 are then likewise trapezoidal.

FIG. 3 shows that the housings 8, 18 partly cover the rack 26 on the bearing plate 12.

The housing 8 is supported by its rear surface 27 on a complementary sliding surface 28 of the bearing plate 12. The rack 26 is best countersunk or recessed into the bearing plate 12 towards the side plate 4 relative to the sliding surfaces 27, 28.

The motors 17 which drive the tensioning mechanism have a reversible rotation so as to adjust the chain tension in either sense.

During operation when the motors 17 are switched on the worm gearing, which forms a reduction gearing; displaces the housing 8 with the mechanism 16 itself with respect to the frame 2 so that the chain entrained around the wheel 9 is slackened or tightened as desired. When the tension has been adjusted the motors 17 are switched off and due to the self-locking nature of the worm gearing the housing 8 remains in the adjusted position. With this arrangement the tension in the plough chain can be set to any desired value over a wide range even with relatively long chains. The mechanism 16 is also quite compact and does not occupy undue space.

The worm gearing can be most effectively protected against the ingress of dirt in the housing 18.

The housing 8 and the chain tensioning mechanism 16 can be disposed at the main drive station and/or at the auxiliary drive station usually at the opposite ends of the conveyor 1.

It is possible to replace the double motor drive 17 with a single motor and to use an electric motor or motors instead of the hydraulic motor or motors.

The starting and stopping of the tensioning mechanism motor or motors can be effected automatically in a controlled manner depending on the prevailing chain tension.

We claim:

1. In or for a mineral mining installation comprising a scraper-chain conveyor, a mineral wining machine movable along the conveyor, and a drive station at least one end of the conveyor, the drive station having a frame, a housing containing a rotatably driven chain wheel for propelling a chain used to drive the winning machine, the housing being displaceable relative to the frame to adjust the tension in the chain; a tensioning system for moving the housing, the tensioning system comprising at least one motor and a self-locking worm gearing driven by the motor.

2. A tensioning system according to claim 1, wherein the worm gearing at least includes a worm wheel which meshes with a rack extending in the direction of the chain.

3. A tensioning system according to claim 2, wherein the rack extends along a side plate of the frame.

4. A tensioning system according to claim 2, wherein the rack is attached to a bearing plate fitted to said frame and guide means is provided between the bearing plate and the housing for permitting slidable displacement of the housing.

5. A tensioning system according to claim 4, wherein the housing and the bearing plate also have surfaces in slidable face to face contact and the rack is recessed in the bearing plate with respect to these sliding surfaces.

6. A tensioning system according to claim 2, wherein the rack has teeth and gaps shaped as circular segments.

7. A tensioning system according to claim 1, wherein the worm gearing is a reduction gearing.

8. A tensioning system according to claim 1, wherein the worm gearing comprises a worm driven by the motor, a shaft carrying first and second worm wheels with the first worm wheel being smaller than the second worm wheel, the first worm wheel meshing with the worm and the second worm wheel meshing with a rack.

9. A tensioning system according to claim 8, wherein the shaft carrying the first and second worm wheels extends in the direction of the chain.

10. A tensioning system according to claim 1 wherein the worm gearing is located in the housing.

11. A tensioning system according to claim 1, wherein the worm gearing is located in an auxiliary housing affixed to the housing containing the chain wheel.

12. A tensioning system according to claim 1, wherein the motor is a hydraulic, reversible rotary motor.

13. A tensioning system according to claim 12, wherein there are two such motors driving a stub shaft carrying the worm.

* * * * *